US010478672B1

(12) United States Patent
Reyes

(10) Patent No.: US 10,478,672 B1
(45) Date of Patent: Nov. 19, 2019

(54) WALKABLE WATER SHOE WITH INCORPORATED SWIM FIN APPENDAGE

(71) Applicant: David Martin Reyes, Cameron Park, CA (US)

(72) Inventor: David Martin Reyes, Cameron Park, CA (US)

(73) Assignee: David Martin Reyes, Rocklin, CA (US)

( * ) Notice: Subject to any disclaimer, the term of this patent is extended or adjusted under 35 U.S.C. 154(b) by 0 days.

(21) Appl. No.: 14/639,931

(22) Filed: Mar. 5, 2015

(51) Int. Cl.
*A63B 31/11* (2006.01)

(52) U.S. Cl.
CPC ..... *A63B 31/11* (2013.01); *A63B 2031/117* (2013.01)

(58) Field of Classification Search
CPC ..... A63B 31/11
USPC ..... 441/64
See application file for complete search history.

(56) References Cited

U.S. PATENT DOCUMENTS 2,980,926 A * 4/1961 Wolshin ..... A63B 31/11 441/64
4,599,071 A * 7/1986 Juang ..... A63B 31/11 441/61
5,183,424 A * 2/1993 Field ..... A63B 31/11 441/64
7,159,336 B2 * 1/2007 Burns ..... A63B 31/11 36/8.1
7,658,659 B1 * 2/2010 Fraser ..... A63B 31/11 441/63
7,736,208 B2 * 6/2010 Bonis ..... A63B 31/11 441/64
7,828,615 B2 * 11/2010 Bonis ..... A63B 31/11 441/61
8,087,959 B2 * 1/2012 Hsu ..... A63B 31/11 24/614
8,333,020 B1 * 12/2012 Sanchez ..... A43B 3/24 36/100
2009/0170388 A1 * 7/2009 Bonis ..... A63B 31/11 441/64
2010/0029152 A1 * 2/2010 Fraser ..... A63B 31/11 441/64
2010/0203779 A1 * 8/2010 Bonis ..... A63B 31/11 441/64
2011/0312231 A1 * 12/2011 Montemurro ..... A63B 31/11 441/64
2013/0183877 A1 * 7/2013 Fraser ..... A63B 31/11 441/64

FOREIGN PATENT DOCUMENTS

WO WO2004/014496 2/2004

* cited by examiner

*Primary Examiner* — S. Joseph Morano
*Assistant Examiner* — Jovon E Hayes

(57) ABSTRACT

A water shoe which is comprised of a neoprene, polychloroprene, nylon, polyester or rubber material like upper boot or sock attached to a traction sole and having an elevated swim fin appendage which does not obstruct normal walking motion. The neoprene water shoe with an elevated swim fin appendage allows a user to walk with a normal stride on land and also to enter the water and engage in swimming activities without having to change into separate swim fins.

8 Claims, 6 Drawing Sheets

WALKABLE WATER SHOE WITH INCORPORATED SWIM FIN APPENDAGE

RELATED APPLICATIONS

This application claims the benefit of U.S. Provisional Application Ser. No. 61/966,834 filed Mar. 5, 2015.

TECHNICAL FIELD

This invention relates to water shoes, and more specifically, to a neoprene, polychloroprene, nylon, polyester or rubber material like water shoe having a elevated swim fin appendage integrated with a traction grip sole wherein the water shoe operates in normal walking activities without the elevated swim fin appendage obstructing the walking motion of the user on land, and wherein the water shoe with elevated swim fin appendage can be used in water sports or swimming activities without having to change into a separate set of swim fins.

BACKGROUND

Water sports, such as swimming, body boarding, wading, snorkeling, jet-skiing and scuba diving usually require that the participant transition from land to water. The water transition can involve the participant encountering currents and waves which require a greater propulsive force to overcome than can be provided by bare feet alone. Typically, the water sport participant will have one pair of shoes for walking on land and the transition to water requires the removal of shoes and donning swim fins to achieve adequate water propulsion. Neoprene water shoes are often used by water sport participants for land purposes, including wading, but the transition to swimming usually requires that swim fins be worn over the neoprene water shoes, or that the water shoes be replaced by the swim fins.

The problem has always been that the wearing of swim fins prevents travel on land as any attempt to walk in swim fins is, for the most part, a futile exercise. Therefore, it has been the norm for water sports participants to don either swim fins, or shoes, depending on whether the environment is water or land, respectively.

There have been attempts in the prior art to create water shoes which merge the practicality of walking shoes with a swim fin appendage, but none have disclosed an embodiment of a functional water shoe that would allow a walker to walk in the shoe while the swim fin was in a deployed position. International Publication No. WO 2004/014496 to D'Annibale discloses a water shoe that requires the swim fin appendage to be detached and repositioned for transitioning between a walking and swimming configuration. United States Patent Publication Nos. 2009/0170388 and 2010/0203779 to Bonis et. al. disclose a water shoe having a retractable swim fin which is stored in an interior compartment within the shoe when it is not in use. The fin itself emerges from the compartment and is deployed like a fan. However, presumably when the fin is deployed, the user cannot walk because the fin must be retracted and placed back into the compartment in order for the user to walk in the shoe. U.S. Design No. D592,839 issued to the present inventor has illustrations of a shoe having a swim fin appendage, but represents mainly the "idea" of a swim fin shoe and does not describe how it is functionally accomplished.

The invention is a neoprene, polychloroprene, nylon, and polyester or rubber material like water shoe with a traction sole which is functionally a practical walking shoe, yet allows the wearer to enter a water environment with an attached elevated swim fin appendage which provides practical and real propulsion. The inventive neoprene, nylon, polyester or rubber material like water shoe integrated with a traction sole employs an elevated swim fin appendage joined to the shoe in a manner which allows normal standing and walking without experiencing obstruction between the elevated swim fin appendage and the ground.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention is a neoprene, polychloroprene, nylon, polyester or rubber like material water shoe with a traction grip sole having a permanently attached elevated swim fin appendage wherein the neoprene, nylon, polyester or rubber material like water shoe is functional as both a walking shoe and as a swimming fin. The invention as described herein does not require removal or repositioning of the elevated swim fin appendage in order to maintain a comfortable walking motion. The wearer can therefore engage in water sports and transition from a walking environment to a swimming environment without having to change footwear.

Accordingly, the following objects and advantages of the invention apply: It is an object of this invention to provide a neoprene, nylon, polyester or rubber material like water shoe having a elevated permanent swim fin appendage which can be used in a walking environment as well as a swimming environment.

It is another object of this invention to provide a neoprene, nylon, polyester or rubber material like water shoe which does not require removing or repositioning the elevated swim fin appendage when transitioning between a walking environment and a swimming environment.

Further objects and advantages of the invention will be brought out in the following portions of the specification, wherein the detailed description is for the purpose of fully disclosing the preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
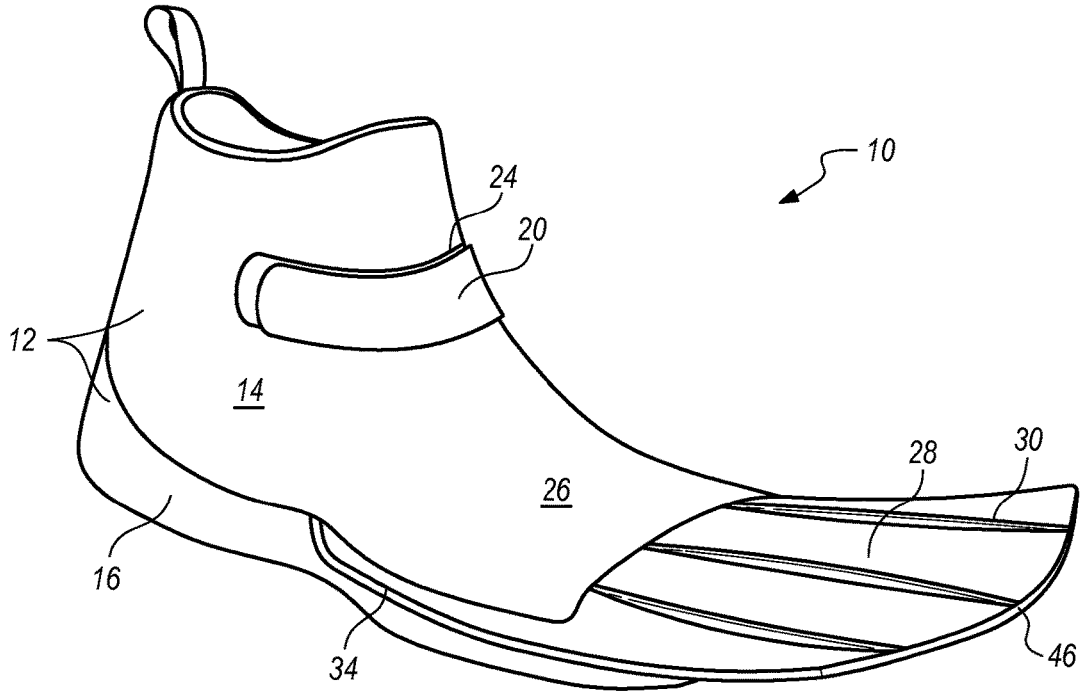
FIG. 1 is a front perspective view of a first embodiment of the inventive neoprene water shoe.

The inventive water shoe 10 is shown as a first embodiment in FIG. 1. Generally the water shoe 10 is comprised of a neoprene, polychloroprene, nylon, polyester or rubber material like shoe portion 12 which is comprised of a neoprene, polychloroprene, nylon, polyester or rubber material like upper 14 attached to a traction grip sole 16. The upper 14 is preferably comprised of a water-resistant material, such as neoprene, polychloroprene, nylon, polyester, rubber or combinations thereof. In a preferred embodiment, as shown, the upper 14 is a neoprene sock molded to a Vibram® sole 16, having a traction gripping tread 18 suitable for walking on outdoor surfaces such as sand, rocks, and coral while protecting the foot from injury. The neoprene sock upper 14 extends over and above the ankles so as to give maximum propulsion and protection during swimming applications. It has been found that the shoe is less effective in a swimming application if the sock upper 14 terminates below the ankles on the wearer, as the water shoe tends to slip or slip off due to water resistance during energetic swimming. A securement strap 20 operates as an added measure to secure the water shoe 10 onto the feet and legs of a wearer, especially during swimming applications. The securement strap 20 is preferably secured above the ankles of the user and is adjustable using a buckle arrangement 22 and securable with an overlapping Velcro® attachment 24. The neoprene water shoe 10 employs a zipper 17 on its interior ankle side to ease donning and removal of the neoprene water shoe.

Figure 2:
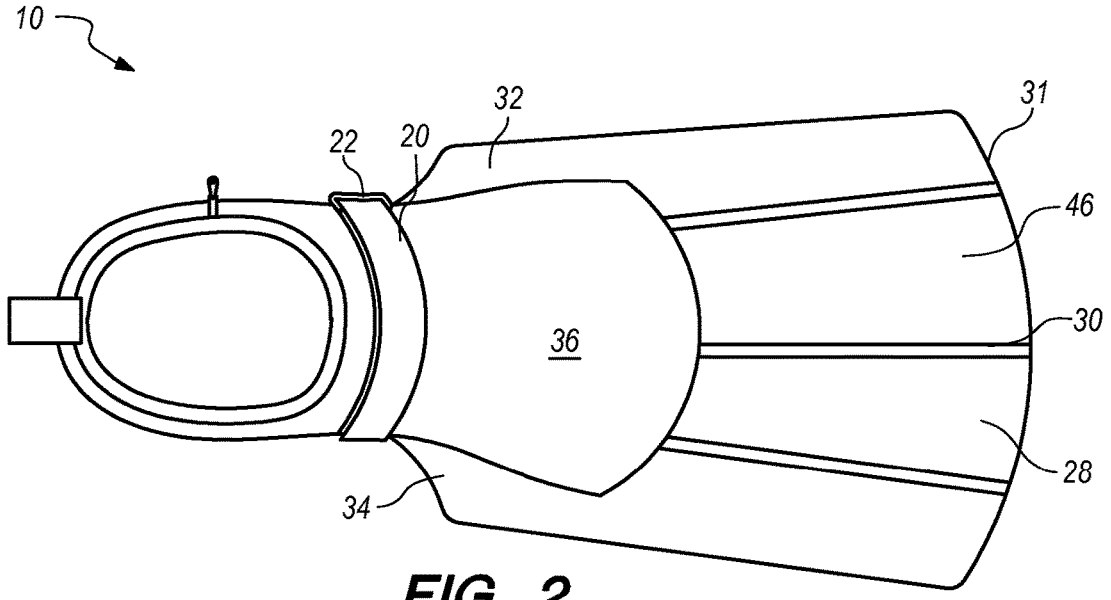
FIG. 2 is a plan view of the first embodiment of the neoprene, polychloroprene, nylon, polyester and or rubber material like water shoe.

Referring to FIG. 2, this plan view shows the vamp 26 of the upper 14 and the top surface 31 of the swim fin appendage 28. The elevated swim fin appendage 28 is attached to the vamp 26 during manufacture by molding the upper 14, the elevated swim fin appendage 28, and the sole 16 together as a single molded unit. The molding of the swim fin appendage 28 to the sole 16 provides a solid anchor for the swim fin appendage 28 to attach. Necessarily, to aid in the molding of the elevated swim fin appendage 28 to the traction sole 16, it is preferable if the elevated swim fin appendage and traction sole are comprised of the similar materials. The elevated swim fin appendage is of a semi-rigid quality which flexes slightly when contacting the ground, during a walking application, or else flexes slightly during swimming applications. The elevated swim fin appendage 28 has a thickness of between 1/16"-1" at its outermost edges and along with the sole 16 is comprised of semi-rigid rubber, polyurethane or thermo-polyurethane. The swim fin appendage 28 achieves additional rigidity by adding small ribs 30 across the top surface 31 of the elevated swim fin appendage.

Figure 3:
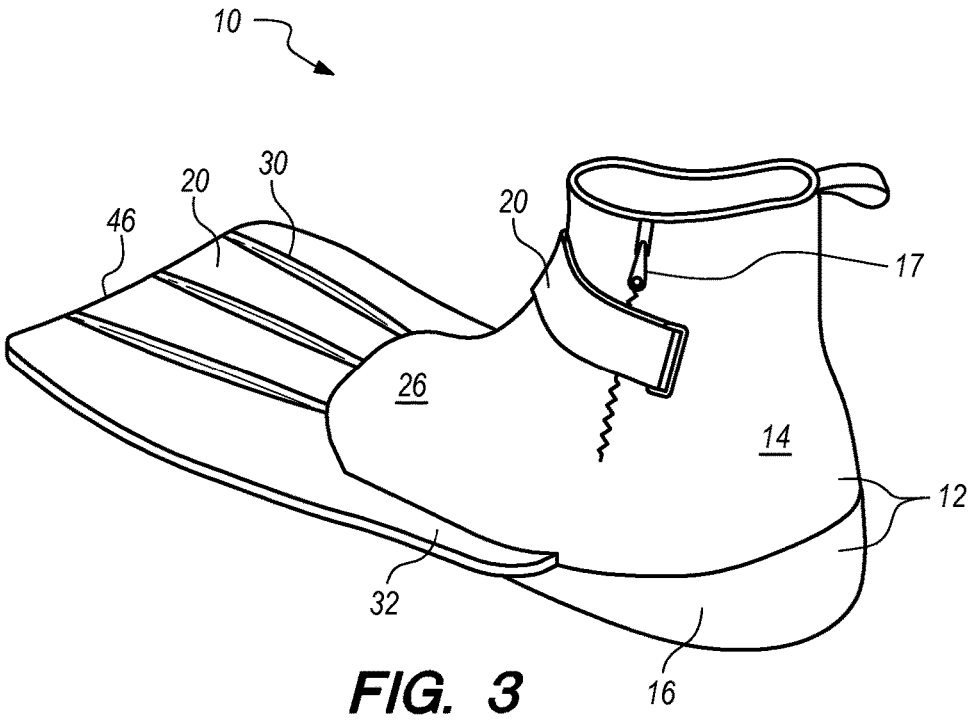
FIG. 3 is a rear elevated perspective view of the first embodiment of the neoprene, polychloroprene, nylon, polyester or rubber material like water shoe.
Figure 4:
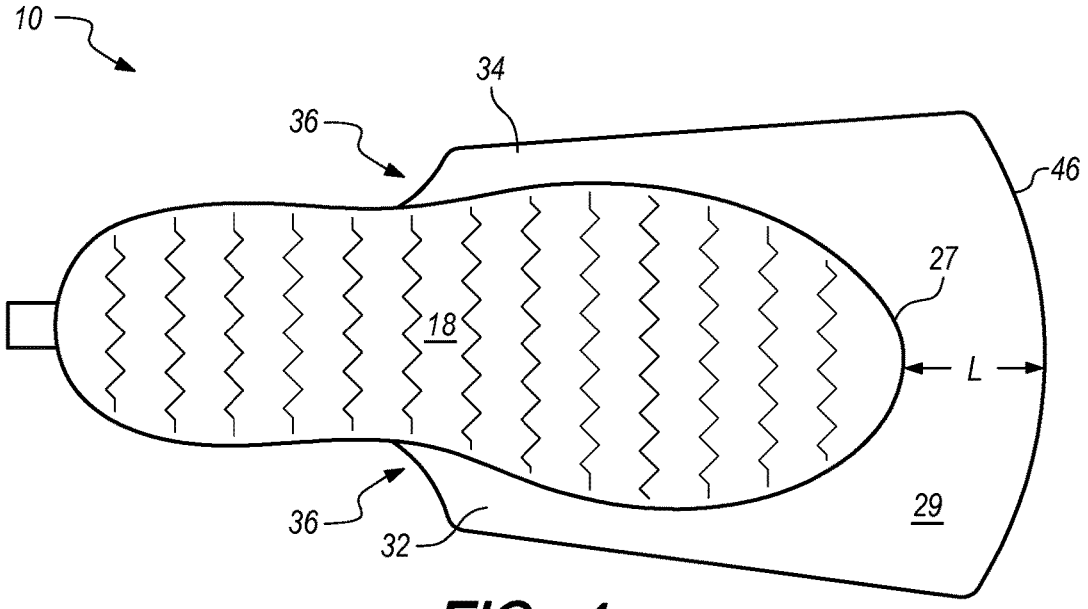
FIG. 4 is a bottom view of the first embodiment of the neoprene, polychloroprene, nylon, polyester or rubber material like water shoe illustrating the bottom of the traction grip sole and bottom surface of the elevated swim fin appendage.

Referring also to FIG. 3, the elevated swim fin appendage 28 includes left and right horizontal lateral side surfaces 32, 34 which provide additional surface area for water contact and displacement during swimming applications. Side surfaces 32, 34 extend laterally and horizontally (relative to the shoe portion 12) outside of the footprint of the shoe portion 12 as shown in FIG. 4, yet present no obstruction to normal walking of the wearer. Side surfaces 32, 34 are molded to the left and right sides of the sole 16 for stability and they extend backward to terminate at approximately the midpoint 36 of the shoe portion 12.

Figure 5:
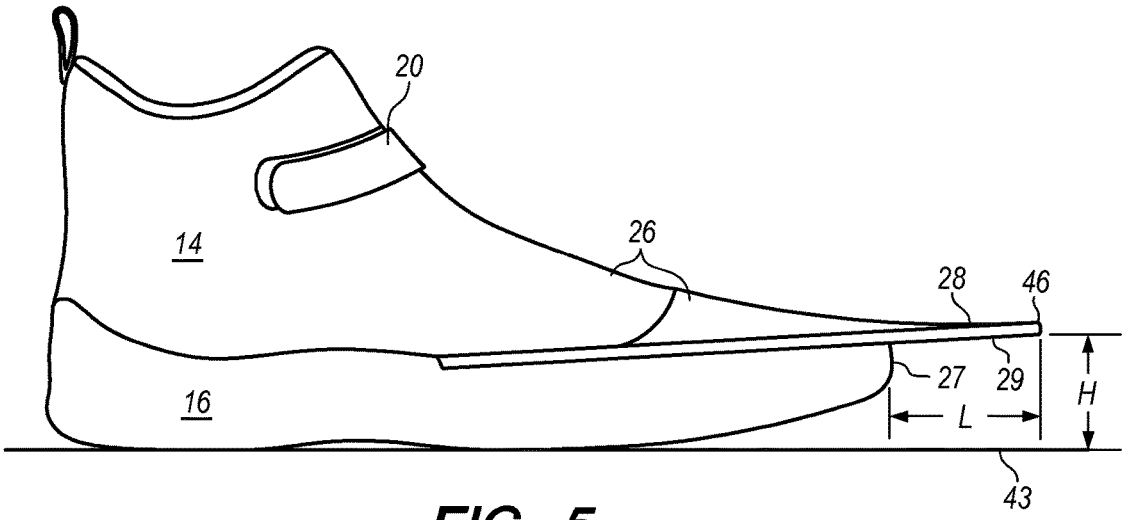
FIG. 5 is a side view of the first embodiment of the neoprene, polychloroprene, nylon, polyester or rubber material like water shoe.
Figure 6:
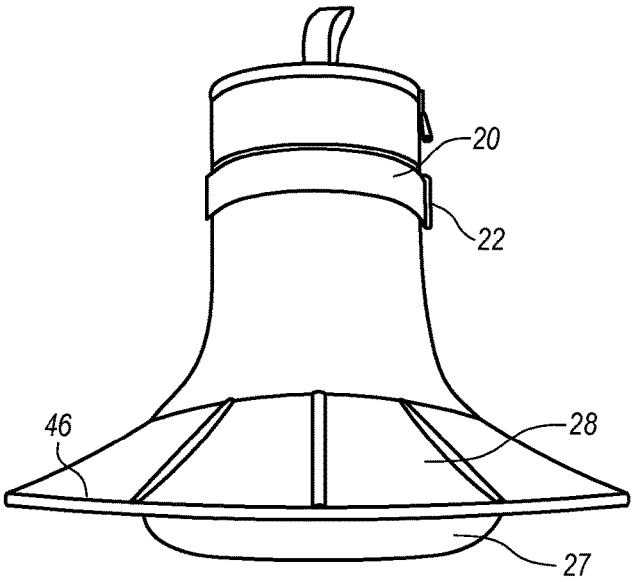
FIG. 6 is a frontal view of the first embodiment of the neoprene, polychloroprene, nylon, polyester or rubber material like water shoe

Referring also to FIGS. 5 and 6, the front edge 46 of elevated swim fin appendage 28 protrudes a distance "L" from the front 27 of the shoe portion 12 which does not obstruct with the ground during a normal walking stride. The optimum protruding distance "L" of the swim fin appendage 28 relative to the front 27 of the shoe portion 12 strikes a balance between un-obstructed walking and providing a elevated swim fin appendage which provides water displacement and propulsion beyond that provided by bare human feet in a swimming environment. Protruding distance "L" has been found to range optimally between 2"-10" in providing a walkable and swimmable water shoe which suffices for the purposes of the invention. The elevated swim fin appendage 28 is able to achieve walkability and swimability additionally through the dimension of height "H" measured from the bottom surface 29 of the elevated swim fin appendage to a flat ground surface 43 as shown in FIG. 5. Height "H" is preferably within a range of 0.125"-2.5". Also, contributing to walkability is a 44 of the elevated swim fin appendage 28 at its front edge 46, which prevents catching on ground surfaces during walking.

Figure 7:
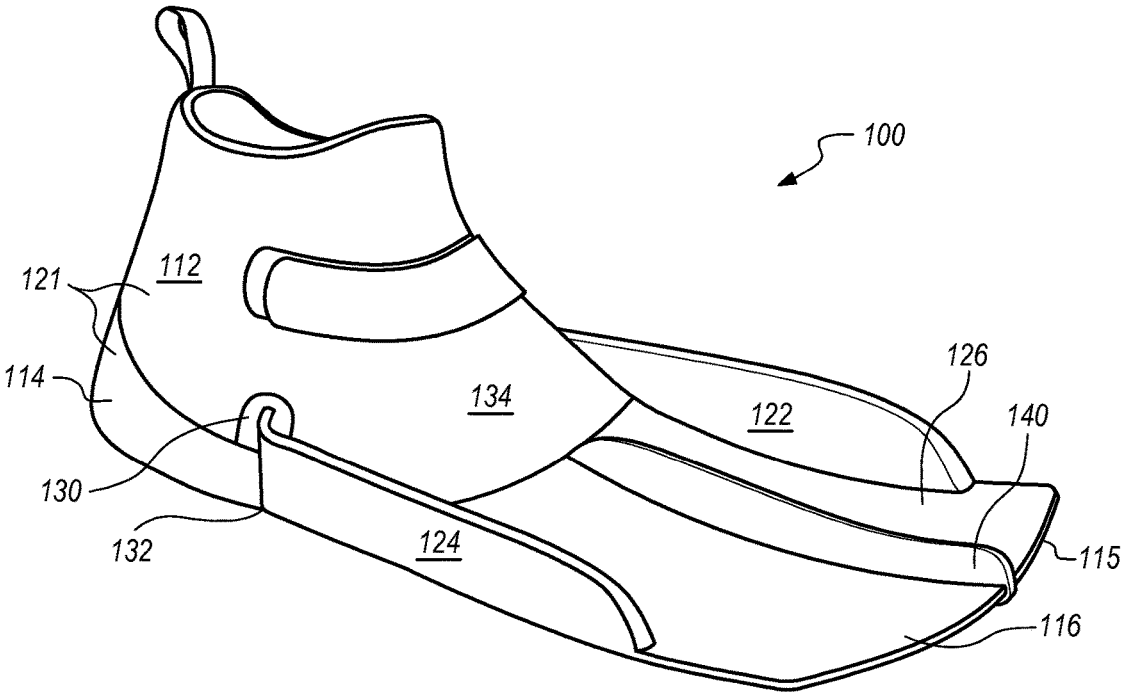
FIG. 7 is a front perspective view of a second embodiment of the inventive neoprene, polychloroprene, nylon, polyester or rubber material like water shoe.
Figure 8:
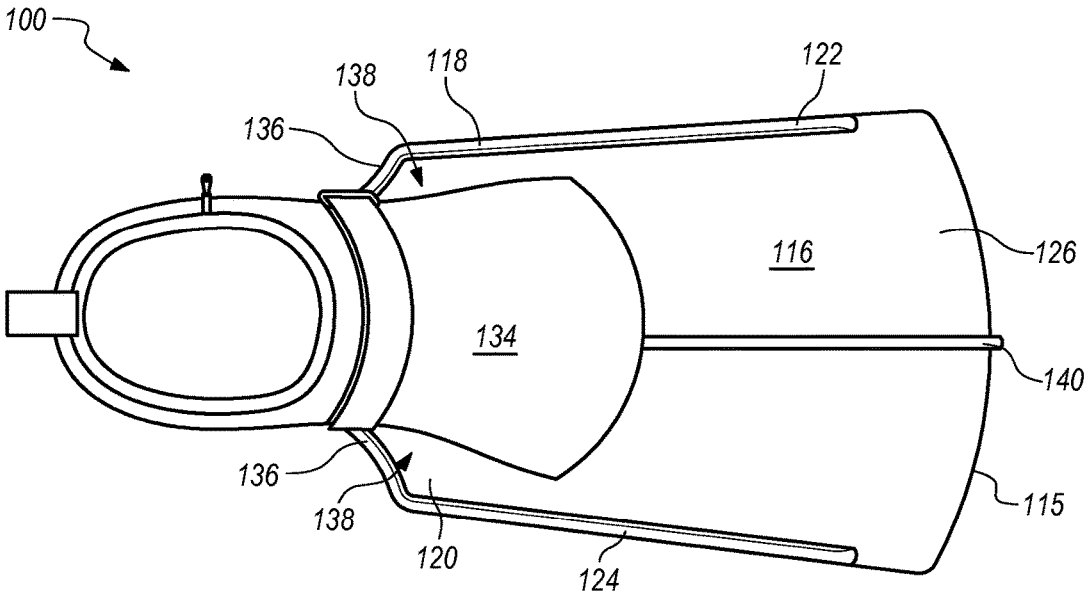
FIG. 8 is a plan view of the second embodiment of the neoprene, polychloroprene, nylon, polyester or rubber material like water shoe.

FIGS. 7 and 8 represent a second embodiment of the inventive water shoe 100. The second embodiment possesses a neoprene sock upper 112, a traction sole 114, and a elevated swim fin appendage 116. The elevated swim fin appendage 116 of the second embodiment 100 is configured for maximal water displacement. Swim fins in general operate by increasing the amount of water displaced by the feet, allowing the feet to push harder against the water and increasing the boost that the legs give to a swimmer's momentum. This allows a swimmer wearing swim fins to swim faster using his feet alone as opposed to using only his arms and bare feet.

As the drawings show, the elevated swim fin appendage 116 of the second embodiment 100 employs left and right horizontal side surfaces 118, 120. Side surfaces 118, 120 extend laterally and horizontally (relative to the shoe portion 121) outside of the footprint of the shoe portion 121, yet present no obstruction to normal walking of the wearer. Side surfaces 118, 120 are connected to left and right lateral side rails 122, 124 which protrude upwardly above the top surface 126 of the elevated swim fin appendage 116. Lateral side rails 122, 124 laterally stabilize the inventive water shoe while a user is thrusting through a water environment, thus insuring even foot thrusts and helping prevent the water shoe from traveling too far left or right. Lateral side rails extend forward of the front 128 of the shoe portion 121 of water shoe 100 and further extend rearwardly to connect to the sole 114 and upper 112 approximately midway 132 along the shoe portion 121. The upper 112 is provided with a reinforced connection point 130 where the side rails 122, 124 attach at the midway point 132 along the shoe portion 121. The side rails also connect to sole 114 at midpoint 132 in addition to connecting to the reinforced connection point 130 of upper 112. The reinforced connection point 130 prevents the side rails 122, 124 from detaching from the upper 112 during use. The connection point 130 is rearward of the vamp 134 wherein the side rails curve inwardly 136 to form lateral cupped pockets 138 upon the swim fin appendage 116. The elevated swim fin appendage is attached to the vamp 134 and occupies much of the surface area comprising the vamp 134. In this configuration, the swim fin appendage 116 can occupy a large surface area without having to extend itself too far forward of the front 128 of shoe portion 121. The cupped pockets 138, the left and right side rails 122, 124 and vamp 134 operate as a unit to capture a greater volume of water for displacement across the top surface 126 of the elevated swim fin appendage during swimming applications.

Figure 9:
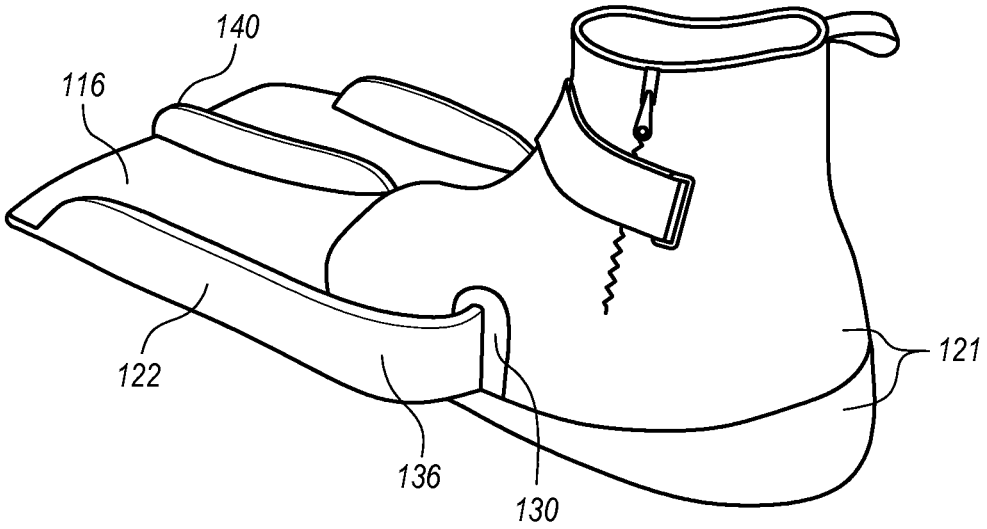
FIG. 9 is a rear elevated perspective view of the second embodiment of the neoprene, polychloroprene, nylon, polyester or rubber material like water shoe.

Referring also to FIG. 9, the elevated swim fin appendage 116 has a vertical center rib 140 which provides reinforcement thereto. The increased water displaced by the elevated swim fin appendage 116 is counter-acted by the vertical center rib 140 located equidistantly between lateral side rails 122, 124. Vertical center rib 140 offers stability to the water shoe while operating in a swimming environment and also prevents the elevated swim fin appendage 116 from collapsing due to the added force imposed by the displacement of water with each leg stroke during swimming applications.

Figure 10:
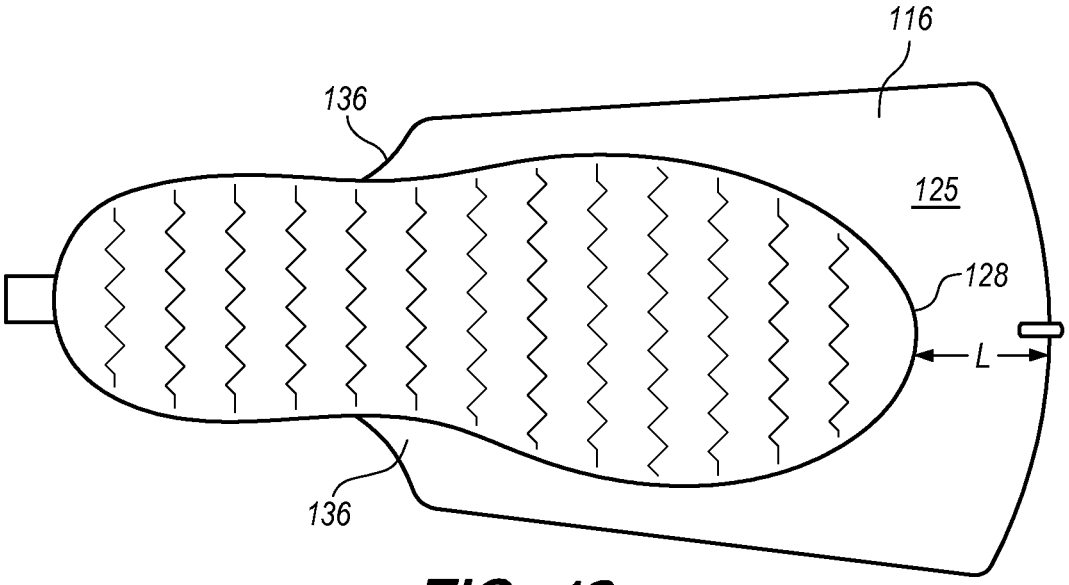
FIG. 10 is a bottom view of the second embodiment of the neoprene, polychloroprene, nylon, polyester or rubber material like water shoe illustrating the bottom of the traction grip sole and bottom surface of the elevated swim fin appendage.
Figure 11:
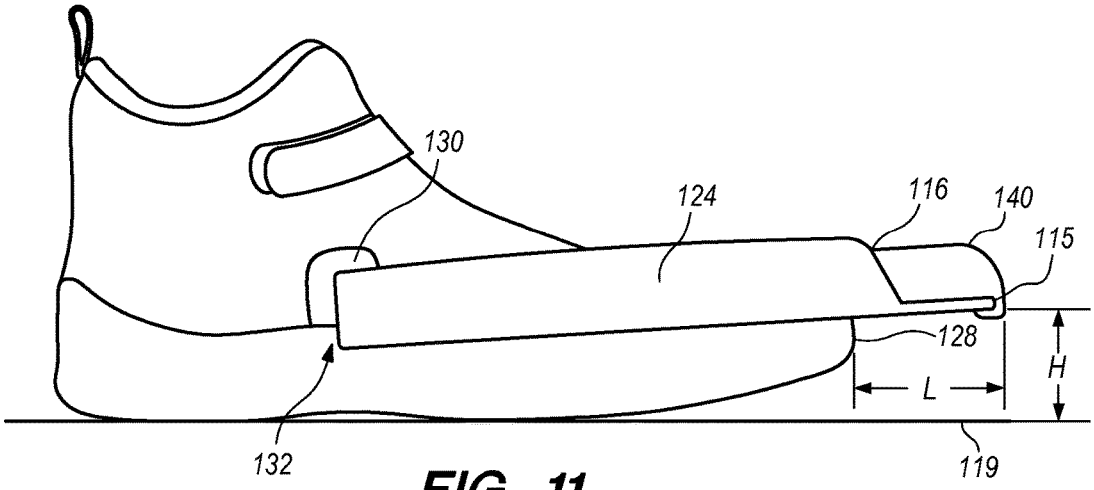
FIG. 11 is a side view of the second embodiment of the neoprene, polychloroprene, nylon, polyester or rubber material like water shoe.
Figure 12:
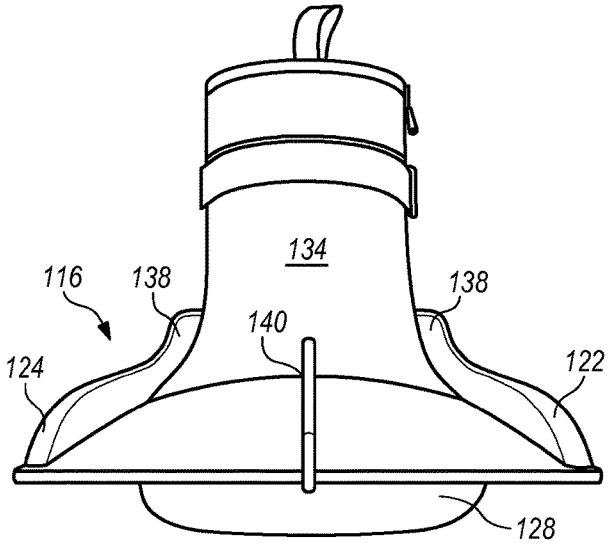
FIG. 12 is a frontal view of the second embodiment of the neoprene, polychloroprene, nylon, polyester or rubber material like water shoe.

Referring also to FIGS. 10-12, the front edge 115 of the elevated swim fin appendage 116 protrudes a distance "L" from the front 128 of the shoe portion 121 which does not obstruct with the ground during a normal walking stride. The optimum protruding distance "L" of the elevated swim fin appendage 116 relative to the front 128 of the shoe portion 121 strikes a balance between un-obstructed walking and providing a elevated swim fin appendage which provides water displacement and propulsion beyond that provided by bare human feet in a swimming environment. Protruding distance "L" has been found to range optimally between 2"-10" in providing a walkable and swimmable water shoe which suffices for the purposes of the invention. The elevated swim fin appendage 116 is able to achieve walkability and swim-ability additionally through the dimension of height "H" measured from the bottom surface 125 of the elevated swim fin appendage to a flat ground surface 119 as shown. Height "H" is preferably within a range of 0.125"-2.5".

Finally, although the description above contains much specificity, this should not be construed as limiting the scope of the invention, but as merely providing illustrations of some of the presently preferred embodiments of this invention. This invention may be altered and rearranged in numerous ways by one skilled in the art without departing from the coverage of any patent claims, which are supported by this specification.

The invention claimed is:

1. A water shoe having an elevated swim fin appendage wherein the elevated swim fin appendage does not obstruct a wearer throughout a normal walking motion; comprising: A shoe portion having a neoprene, nylon, polyester or rubber material upper attached to a traction sole; An elevated swim fin appendage attached to said shoe portion, said elevated swim fin appendage having a neoprene, nylon, polyester or rubber material upper boot or sock and a lower traction sole surface; wherein a front edge of said elevated swim fin appendage protrudes forwardly beyond a front of said shoe portion a distance "L", said distance "L" not obstructing a wearer from engaging in the normal walking motion; Said lower traction sole surface of said elevated swim fin measuring a distance "H" above a flat ground surface, said distance "H" not obstructing a wearer from engaging in the normal walking motion; Said elevated swim fin appendage including left and right side surface areas extending laterally beyond a footprint of said shoe portion, said side surface areas terminating approximately midway along said shoe portion; wherein said distance "L" ranges between 2"-8" and said distance "H" ranges between 1.25"-2.5".

2. The neoprene, nylon, polyester or rubber material water shoe as recited in claim 1, wherein said side surface areas are connected to left and right lateral side rails said lateral side rails connecting to said upper approximately midway along said upper at a connection point, said lateral side rails curving inwardly at said connection point of said upper to form lateral cupped pockets.

3. The neoprene, nylon, polyester or rubber material water shoe as recited in claim 2, wherein said elevated swim fin appendage further comprises a vertical center rib located approximately equidistant between said lateral side rails.

4. The neoprene, nylon, polyester or rubber material water shoe as recited in claim 2, wherein said connection point is reinforced.

5. The neoprene, nylon, polyester or rubber material water shoe as recited in claim 4, wherein said elevated swim fin appendage is further connected to a vamp of said upper.

6. The neoprene, nylon, polyester or rubber material water shoe as recited in claim 5, wherein said connection of said swim fin appendage to said vamp is located forward of said lateral cupped pocket forming a water capture area across the top of said water shoe.

7. A water shoe having an elevated swim fin appendage wherein the elevated swim fin appendage does not obstruct a wearer throughout a normal walking motion, comprising: A shoe portion having a neoprene, nylon, polyester or rubber material upper attached to a traction sole; An elevated swim fin appendage attached to a neoprene, nylon, polyester or rubber material shoe portion, said elevated swim fin appendage having a neoprene, nylon polyester or rubber material upper boot or sock and a lower traction sole surface; Wherein a front edge of said elevated swim fin appendage protrudes forwardly beyond a front of said shoe portion a distance of between 2"-10"; Said lower surface of said elevated swim fin measuring a distance of between 0.125"-2.5" above a flat ground surface; said elevated swim fin appendage including left and right side surface areas extending laterally beyond a footprint of said shoe portion, said side surface areas terminating approximately midway along said shoe portion; and wherein said front edge of said elevated swim fin appendage further comprises an upward curve.

8. A water shoe having an elevated swim fin appendage wherein the elevated swim fin appendage does not obstruct a wearer throughout a normal walking motion; comprising: A shoe portion having a neoprene, nylon, polyester or rubber material upper boot or sock attached to a traction sole; An elevated swim fin appendage attached to said shoe portion, said elevated swim fin appendage having a neoprene, nylon, polyester or rubber material upper boot or sock and a lower traction sole surface; Wherein a front edge of said elevated swim fin appendage protrudes forwardly beyond a front of said shoe portion a distance of between 2"-10"; Said lower traction sole surface of said elevated swim fin measuring a distance of between 0.125"-2.5" above a flat ground surface; said elevated swim fin appendage including left and right side surface areas extending laterally beyond a footprint of said shoe portion, said side surface areas terminating approximately midway along said shoe portion; Left and right lateral side rails connected to said left and right side surfaces, said left and right lateral side rails angling inward at a midpoint along said shoe portion and connecting to said shoe portion at a reinforced connection point.

* * * * *